US010243278B2

(12) United States Patent
Xiao et al.

(10) Patent No.: US 10,243,278 B2
(45) Date of Patent: Mar. 26, 2019

(54) MULTI-FREQUENCY ARRAY ANTENNA

(71) Applicant: Huawei Technologies Co., Ltd., Shenzhen (CN)

(72) Inventors: Weihong Xiao, Shenzhen (CN); Naibiao Wang, Shenzhen (CN); Guoqing Xie, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 15/189,883

(22) Filed: Jun. 22, 2016

(65) Prior Publication Data

US 2016/0301144 A1 Oct. 13, 2016

Related U.S. Application Data

(63) Continuation of application No. PCT/CN2014/094674, filed on Dec. 23, 2014.

(30) Foreign Application Priority Data

Dec. 23, 2013 (CN) ..... 2013 2 0854759 U

(51) Int. Cl.
*H01Q 21/24* (2006.01)
*H01Q 1/24* (2006.01)
(Continued)

(52) U.S. Cl.
CPC ..... *H01Q 21/24* (2013.01); *H01Q 1/246* (2013.01); *H01Q 5/42* (2015.01); *H01Q 9/16* (2013.01); *H01Q 21/061* (2013.01)

(58) Field of Classification Search
None
See application file for complete search history.

(56) References Cited

U.S. PATENT DOCUMENTS

2003/0011539 A1* 1/2003 Kubota ..... G09G 3/2051 345/60
2005/0264463 A1* 12/2005 Gottl ..... H01Q 1/246 343/797

(Continued)

FOREIGN PATENT DOCUMENTS

CN 102832455 A 12/2012
CN 202749516 U 2/2013

(Continued)

*Primary Examiner* — Trinh Dinh
(74) *Attorney, Agent, or Firm* — Leydig, Voit & Mayer, Ltd.

(57) ABSTRACT

The present application provides a multi-frequency array antenna. The multi-frequency array antenna includes at least one dual-polarized low frequency subarray (21) and at least one dual-polarized high frequency subarray (22), where the dual-polarized low frequency subarray (21) and the dual-polarized high frequency subarray (22) are arranged, within a same radome (23), in parallel along an axial direction (24) of the multi-frequency array antenna, the dual-polarized low frequency subarray includes at least two types of dual-polarized low frequency radiation unit pairs (211), and each of the dual-polarized low frequency radiation unit pairs includes at least four low frequency radiation units. In this structure, effective working regions of the multiple low frequency radiation units in each dual-polarized low frequency radiation unit pair cover a larger area, and therefore diameter utilization of the dual-polarized low frequency radiation unit pair is higher, and a gain of the low frequency subarray is higher.

9 Claims, 14 Drawing Sheets

(51) Int. Cl.

| | |
|---|---|
| ***H01Q 9/16*** | (2006.01) |
| ***H01Q 21/06*** | (2006.01) |
| ***H01Q 5/42*** | (2015.01) |

(56) References Cited

U.S. PATENT DOCUMENTS

| | | | | |
|---|---|---|---|---|
| 2007/0008236 | A1* | 1/2007 | Tillery | H01Q 21/30 343/797 |
| 2008/0062062 | A1* | 3/2008 | Borau | H01Q 1/246 343/844 |
| 2009/0278759 | A1 | 11/2009 | Moon et al. | |
| 2010/0201590 | A1* | 8/2010 | Girard | H01Q 1/246 343/766 |
| 2011/0043425 | A1* | 2/2011 | Timofeev | H01Q 1/246 343/817 |
| 2012/0280879 | A1 | 11/2012 | Zimmerman et al. | |
| 2013/0285852 | A1* | 10/2013 | Teillet | H01Q 3/38 342/368 |
| 2014/0139387 | A1* | 5/2014 | Jones | H01Q 21/30 343/794 |
| 2014/0368395 | A1* | 12/2014 | Dauguet | H01Q 1/246 343/798 |
| 2015/0009078 | A1 | 1/2015 | Sun et al. | |
| 2015/0288065 | A1* | 10/2015 | Liu | H01Q 1/246 343/835 |

FOREIGN PATENT DOCUMENTS

| | | | |
|---|---|---|---|
| CN | 103036019 | A | 4/2013 |
| CN | 103094715 | A | 5/2013 |
| CN | 203813033 | U | 9/2014 |

* cited by examiner

MULTI-FREQUENCY ARRAY ANTENNA

CROSS-REFERENCE TO RELATED APPLICATIONS

This application is a continuation of International Application No. PCT/CN2014/094674, filed on Dec. 23, 2014, which claims priority to Chinese Patent Application No. 201320854759.7, filed on Dec. 23, 2013, both of which are hereby incorporated by reference in their entireties.

TECHNICAL FIELD

The present application relates to the field of communications technologies, and in particular, to a multi-frequency array antenna.

BACKGROUND

With development of mobile communications, increasingly higher user requirements on high-speed data transmission, and increasingly diversified demands of users, modern mobile communications is developing towards a direction of multi-frequency multi-mode. An upgrade speed of mobile communications device is gradually accelerating. However, it is increasingly difficult to acquire available site resources in an urban area. Therefore, multi-frequency multi-mode operation becomes one direction of future development for base station antennas. A multi-frequency multi-mode base station antenna also provides a more effective solution for site sharing of mobile communication operators, and provides the benefits of smooth upgrade of a live-network device and being green and energy-saving.

For the multi-frequency multi-mode base station antenna, namely, a multi-frequency array antenna, one same antenna needs to include multiple antenna subarrays that can work on a same frequency band or different frequency bands. However, limited installation space and broadband operation of the antenna subarrays bring new challenges to antenna design.

In the prior art, a multi-frequency array antenna, as the one shown in FIG. 1, may be used. The antenna is arranged in the following order: a high frequency subarray 11, a low frequency subarray 12, and a high frequency subarray 13. Although a size of the multi-frequency array antenna is compact, and the two high frequency subarrays have relatively consistent electrical performance indicators, a gain of the low frequency subarray is relatively low.

SUMMARY

Embodiments of the present application provide a multi-frequency array antenna, which can increase a gain of a low frequency subarray in the multi-frequency array antenna.

To resolve the foregoing technical problem, the embodiments of the present application disclose the following technical solutions:

According to a first aspect, a multi-frequency array antenna is provided, including at least one dual-polarized low frequency subarray and at least one dual-polarized high frequency subarray, where the dual-polarized low frequency subarray and the dual-polarized high frequency subarray are arranged, within a same radome, in parallel along an axial direction of the multi-frequency array antenna, the dual-polarized low frequency subarray includes at least two types of dual-polarized low frequency radiation unit pairs, and each of the dual-polarized low frequency radiation unit pairs includes at least four low frequency radiation units.

With reference to the first aspect, in a first possible implementation manner, combination manners of low frequency radiation units in the at least two types of dual-polarized low frequency radiation unit pairs are different.

With reference to the first aspect, and/or the first possible implementation manner, in a second possible implementation manner, the at least two types of dual-polarized low frequency radiation unit pairs are alternately arranged along the axial direction of the multi-frequency array antenna.

With reference to the first aspect, and/or the first possible implementation manner, and/or the second possible implementation manner, in a third possible implementation manner, the dual-polarized low frequency radiation unit pair includes four L-shaped low frequency radiation units.

With reference to the first aspect, and/or the first possible implementation manner, and/or the second possible implementation manner, and/or the third possible implementation manner, in a fourth possible implementation manner, there are two columns or four columns of the dual-polarized high frequency.

With reference to the first aspect, and/or the first possible implementation manner, and/or the second possible implementation manner, and/or the third possible implementation manner, and/or the fourth possible implementation manner, in a fifth possible implementation manner, the dual-polarized high frequency subarrays are symmetric about an axis of the multi-frequency array antenna.

With reference to the first aspect, and/or the first possible implementation manner, and/or the second possible implementation manner, and/or the third possible implementation manner, and/or the fourth possible implementation manner, and/or the fifth possible implementation manner, in a sixth possible implementation manner, there are three columns of dual-polarized high frequency subarrays.

In the embodiments of the present application, a dual-polarized low frequency subarray includes multiple dual-polarized low frequency radiation unit pairs. Each dual-polarized low frequency radiation unit pair further includes multiple low frequency radiation units. As compared with a low frequency subarray that directly includes a single low frequency radiation unit in the prior art, in this structure, effective working regions of the multiple low frequency radiation units in each dual-polarized low frequency radiation unit pair cover a larger area, and therefore diameter utilization of the dual-polarized low frequency radiation unit pair is higher, and a gain of the low frequency subarray is higher.

BRIEF DESCRIPTION OF DRAWINGS

To describe the technical solutions in the embodiments of the present application more clearly, the following briefly introduces the accompanying drawings required for describing the embodiments of the present application. Apparently, the accompanying drawings in the following description show merely some embodiments of the present application, and a person of ordinary skill in the art may still derive other drawings from these accompanying drawings without creative efforts.

DESCRIPTION OF EMBODIMENTS

To make a person skilled in the art understand the technical solutions in the embodiments of the present application better, and make the objectives, features, and advantages of the embodiments of the present application clearer, the following further describes the technical solutions in the embodiments of the present application in detail with reference to the accompanying drawings.

Figure 1:
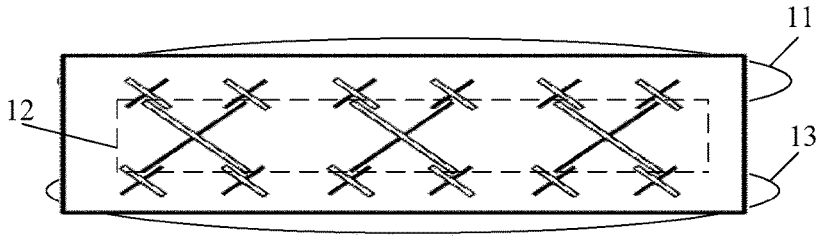
FIG. 1 is a schematic structural diagram of a multi-frequency array antenna in the prior art.
Figure 2:
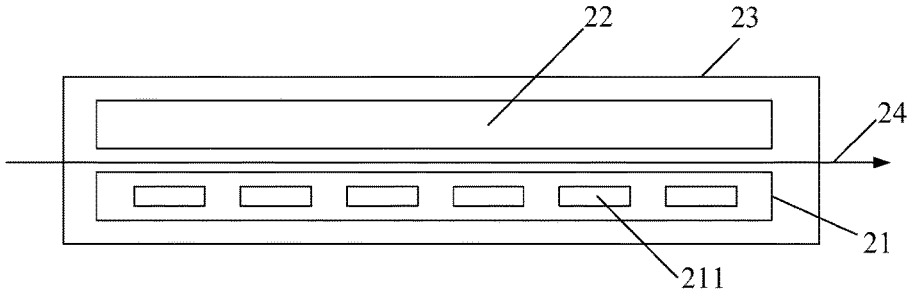
FIG. 2 is a schematic structural diagram of a multi-frequency array antenna according to an embodiment of the present application.

Refer to FIG. 2, which is a schematic structural diagram of a multi-frequency array antenna according to an embodiment of the present application.

The multi-frequency array antenna includes at least one dual-polarized low frequency subarray 21 and at least one dual-polarized high frequency subarray 22, where the dual-polarized low frequency subarray 21 and the dual-polarized high frequency subarray 22 are arranged, within a same radome 23, in parallel along an axial direction 24 of the multi-frequency array antenna. The axial direction 24 of the multi-frequency array antenna is a direction of an axis of the multi-frequency array antenna.

The dual-polarized low frequency subarray 21 may include two or more types of dual-polarized low frequency radiation unit pairs 211. Each dual-polarized low frequency radiation unit pair 211 includes two or more low frequency radiation units, for example, four low frequency radiation units. The low frequency radiation units in each dual-polarized low frequency radiation unit pair 211 may be arranged along the axial direction 24 of the multi-frequency array antenna, or may be arranged to be perpendicular to the axial direction 24. Certainly, there may be other arrangement manners.

In this embodiment of the present application, the dual-polarized low frequency subarray includes multiple dual-polarized low frequency radiation unit pairs. Each dual-polarized low frequency radiation unit pair further includes multiple low frequency radiation units. As compared with a low frequency subarray that directly includes a single low frequency radiation unit in the prior art, in this structure, effective working regions of the multiple low frequency radiation units in each dual-polarized low frequency radiation unit pair cover a larger area, and therefore diameter utilization of the dual-polarized low frequency radiation unit pair is higher, and a gain of the low frequency subarray is higher.

Figure 3:
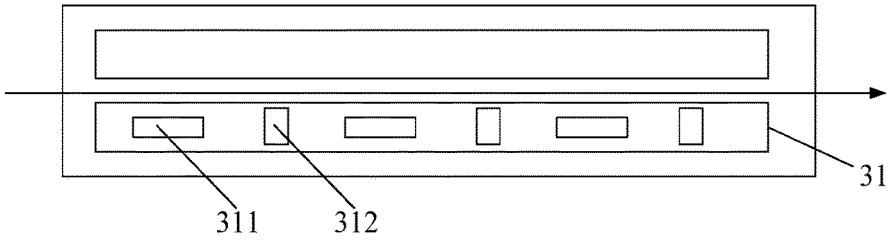
FIG. 3 is a schematic structural diagram of another multi-frequency array antenna according to an embodiment of the present application.

In another embodiment of the present application, combination manners of low frequency radiation units in the at least two types of dual-polarized low frequency radiation unit pairs of the dual-polarized low frequency subarray are different. Preferably, different dual-polarized low frequency radiation units may be alternately arranged along an axial direction of the multi-frequency array antenna. Two types of dual-polarized low frequency radiation unit pairs are used as an example for description. As shown in FIG. 3, the multi-frequency array antenna includes at least one dual-polarized low frequency subarray 31. The subarray includes two types of dual-polarized low frequency radiation unit pairs 311 and 312. Combination manners of low frequency radiation units in the two types of dual-polarized low frequency radiation unit pairs 311 and 312 are different. Low frequency radiation units in the dual-polarized low frequency radiation unit pair 311 are arranged along the axial direction of the multi-frequency array antenna. Low frequency radiation units in the dual-polarized low frequency radiation unit pair 312 are arranged to be perpendicular to the axial direction of the multi-frequency array antenna. The dual-polarized low frequency radiation unit pairs 311 and 312 are alternately arranged along the axial direction of the multi-frequency array antenna.

In this embodiment, effective working regions of the multiple low frequency radiation units in each dual-polarized low frequency radiation unit pair cover a larger area, and therefore diameter utilization of the dual-polarized low frequency radiation unit pair is higher, and a gain of the low frequency subarray is higher. In another embodiment of the present application, each dual-polarized low frequency radiation unit pair may consist of at least two low frequency radiation units, for example, may consist of two T-shaped low frequency radiation units, or may consist of four L-shaped low frequency radiation units. Certainly, each dual-polarized low frequency radiation unit pair may consist of low frequency radiation units of other shapes.

This embodiment of the present application does not limit the dual-polarized high frequency subarray. The multi-frequency array antenna may include two, three, or four columns of dual-polarized high frequency subarrays. Each dual-polarized high frequency subarray may include at least one high frequency radiation unit. Preferably, when a quantity of the dual-polarized high frequency subarrays is an even number, the dual-polarized high frequency subarrays are symmetric about the axis of the multi-frequency array antenna, so that electrical characteristics of the dual-polarized high frequency subarrays can be relatively consistent.

The following describes the multi-frequency array antenna in the embodiments of the present application by using specific instances.

Figure 4A:
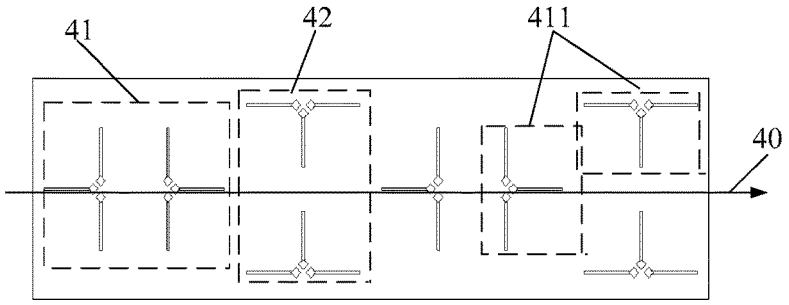
FIG. 4*a* is a schematic structural diagram of a dual-polarized low frequency subarray of a multi-frequency array antenna according to an embodiment of the present application.
Figure 4B:
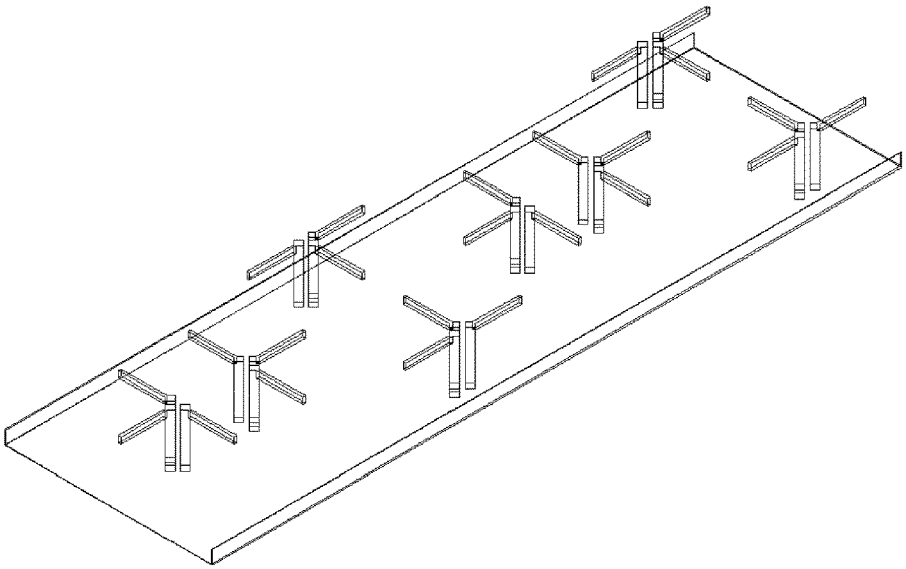
FIG. 4*b* is a three-dimensional schematic structural diagram of the dual-polarized low frequency subarray in the embodiment shown in FIG. 4*a;*
Figure 4C:
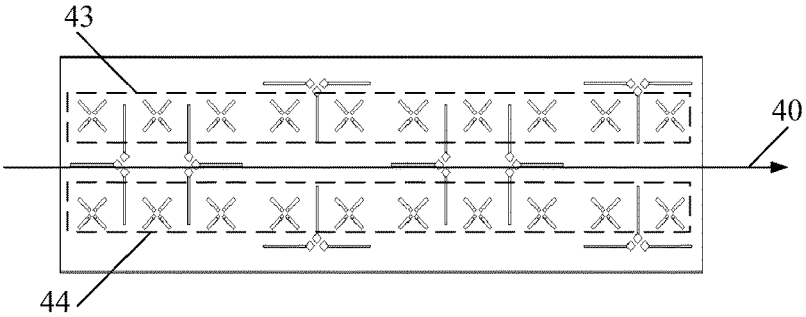
FIG. 4*c* to FIG. 4*h* are schematic structural diagrams of a multi-frequency array antenna that includes the dual-polarized low frequency subarray shown in FIG. 4*a;*

Refer to FIG. 4*a* to FIG. 4*c*, which are schematic structural diagrams of another multi-frequency array antenna according to an embodiment of the present application.

As shown in FIG. 4*a* and FIG. 4*b*, the multi-frequency array antenna includes one dual-polarized low frequency subarray. The dual-polarized low frequency subarray includes two types of dual-polarized low frequency radiation unit pairs 41 and 42. The dual-polarized low frequency radiation unit pairs 41 and 42 are alternately arranged along an axis 40 of the multi-frequency array antenna. Each type of dual-polarized low frequency radiation unit pair includes two T-shaped low frequency radiation units 411. Two T-shaped low frequency radiation units in the dual-polarized low frequency radiation unit pair 41 are arranged in a manner of being symmetric about a direction that is perpendicular to the axis 40 of the multi-frequency array antenna. Two T-shaped low frequency radiation units in the dual-polarized low frequency radiation unit pair 42 are arranged in a manner of being symmetric about a direction of the axis 40 of the multi-frequency array antenna.

Figure 4D:
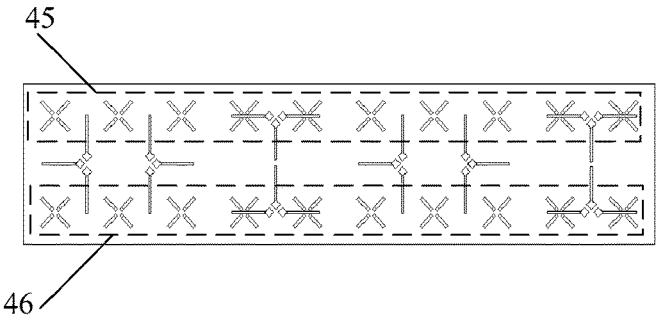
Figure 4E:
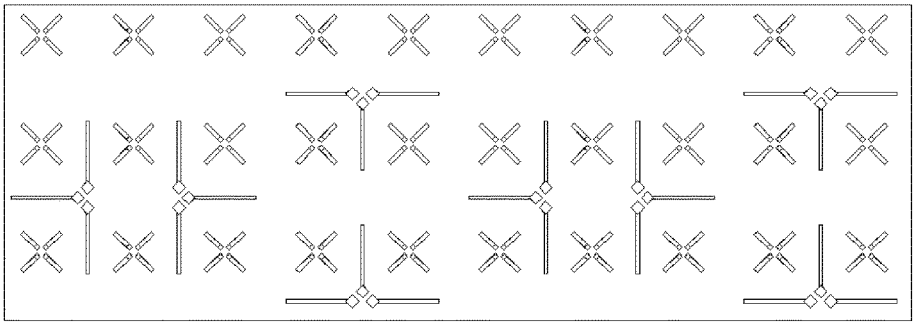
Figure 4F:
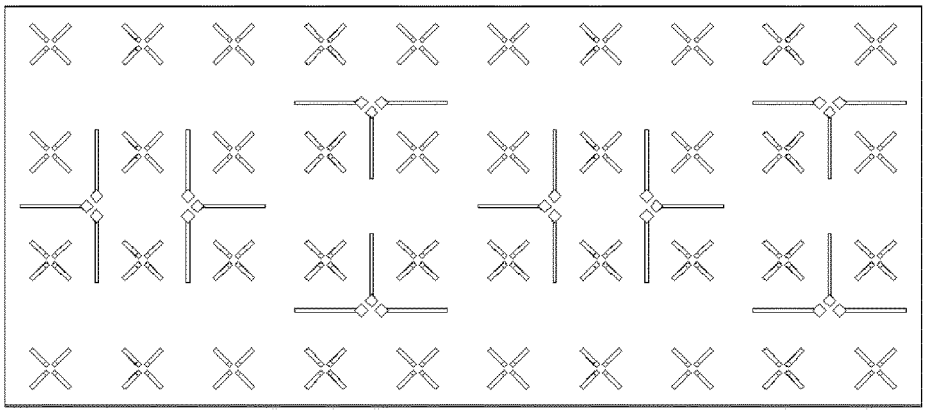
Figure 4G:
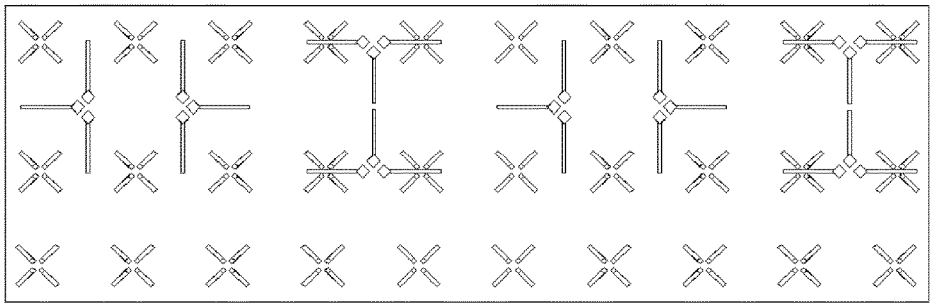
Figure 4H:
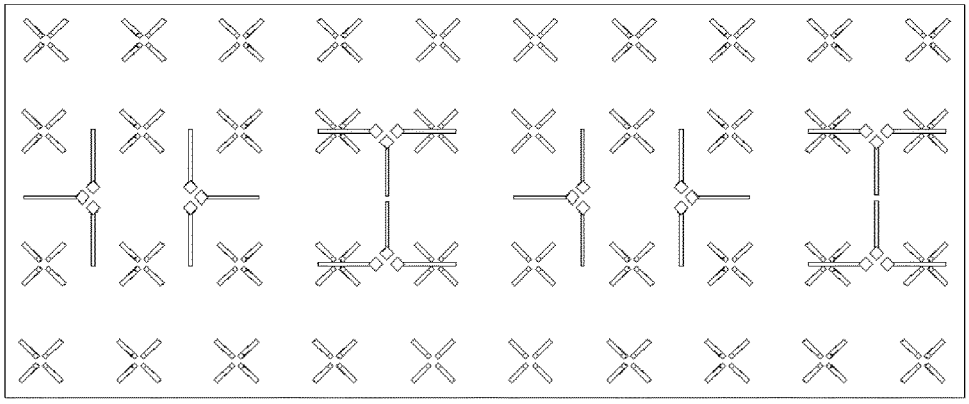

As shown in FIG. 4*c*, the multi-frequency array antenna includes two dual-polarized high frequency subarrays 43 and 44. The two dual-polarized high frequency subarrays 43 and 44 are symmetric about the axis 40 of the multi-frequency array antenna. Each dual-polarized high frequency subarray is formed by independent high frequency radiation units that are arranged along the direction of the axis 40 of the multi-frequency array antenna. Arrangement locations of the two dual-polarized high frequency subarrays may further be shown in FIG. 4*d*, where a spacing between dual-polarized high frequency subarrays 45 and 46 is greater than a spacing between the dual-polarized high frequency subarrays 43 and 44 in FIG. 4*c*.

In another embodiment, the multi-frequency array antenna may include three or four dual-polarized high frequency subarrays. An arrangement manner of the dual-polarized high frequency subarrays may be shown in FIG. 4*e*, FIG. 4*f*, FIG. 4*g*, or FIG. 4*h*. When a quantity of the dual-polarized high frequency subarrays is an even number, the dual-polarized high frequency subarrays are symmetric about the axis of the multi-frequency array antenna, so that electrical characteristics of the dual-polarized high frequency subarrays can be relatively consistent.

Figure 5A:
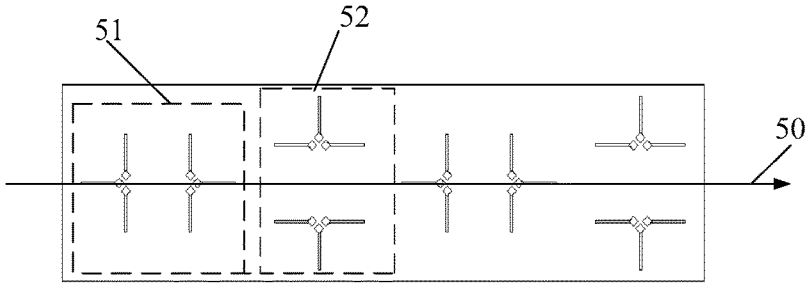
FIG. 5*a* is a schematic structural diagram of a dual-polarized low frequency subarray of another multi-frequency array antenna according to an embodiment of the present application.
Figure 5B:
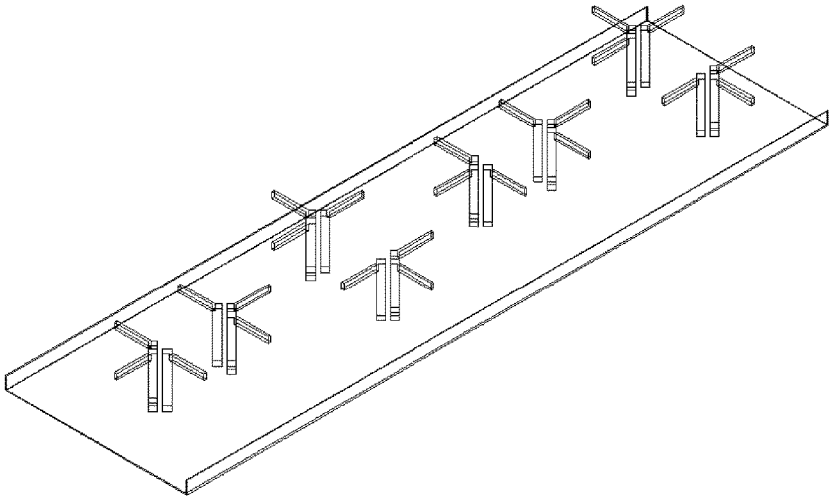
FIG. 5*b* is a three-dimensional schematic structural diagram of the dual-polarized low frequency subarray in the embodiment shown in FIG. 5*a;*
Figure 5C:
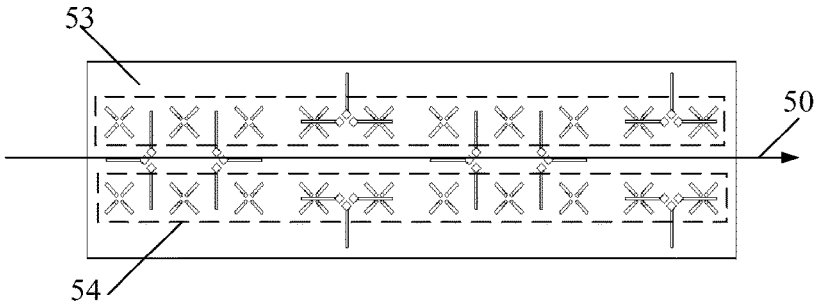
FIG. 5*c* to FIG. 5*e* are schematic structural diagrams of a multi-frequency array antenna that includes the dual-polarized low frequency subarray shown in FIG. 5*a;*

Refer to FIG. 5*a* to FIG. 5*c*, which are schematic structural diagrams of another multi-frequency array antenna according to an embodiment of the present application.

As shown in FIG. 5*a* and FIG. 5*b*, the multi-frequency array antenna also includes one dual-polarized low frequency subarray. The dual-polarized low frequency subarray includes two types of dual-polarized low frequency radiation unit pairs 51 and 52. The dual-polarized low frequency radiation unit pairs 51 and 52 are alternately arranged along an axis 50 of the multi-frequency array antenna. A difference between this dual-polarized low frequency subarray and the dual-polarized low frequency subarray shown in the foregoing FIG. 4*a* and FIG. 4*b* is that an arrangement manner of two T-shaped low frequency radiation units in the dual-polarized low frequency radiation unit pair 52 is different from an arrangement manner of the two T-shaped low frequency radiation units in the dual-polarized low frequency radiation unit pair 42. The two T-shaped low frequency radiation units in the dual-polarized low frequency radiation unit pair 42 are arranged facing towards each other along a direction that is perpendicular to the axis 50 of the multi-frequency array antenna, while the two T-shaped low frequency radiation units in the dual-polarized low frequency radiation unit pair 52 are arranged back to back. Arrangement manners of low frequency radiation units in the dual-polarized low frequency radiation unit pair 51 and the dual-polarized low frequency radiation unit pair 41 are the same.

As shown in FIG. 5*c*, the multi-frequency array antenna includes two dual-polarized high frequency subarrays 53 and 54. The two dual-polarized high frequency subarrays 53 and 54 are symmetric about the axis 50 of the multi-frequency array antenna. Each dual-polarized high frequency subarray is formed by independent high frequency radiation units that are arranged along a direction of the axis 50 of the multi-frequency array antenna.

Figure 5D:
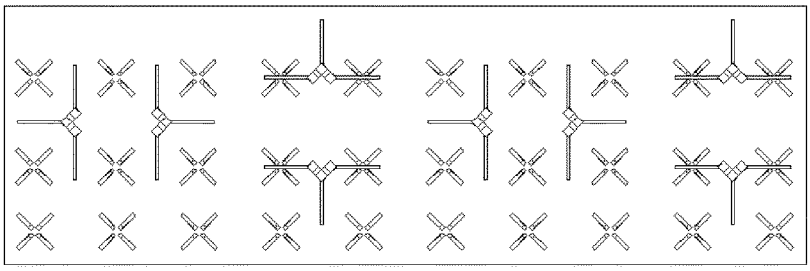
Figure 5E:
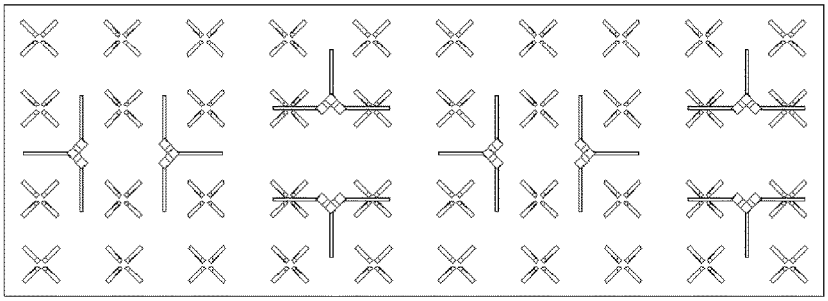

In another embodiment, the multi-frequency array antenna may include three or four dual-polarized high frequency subarrays. An arrangement manner of the dual-polarized high frequency subarrays may be shown in FIG. 5*d* or FIG. 5*e*. When a quantity of the dual-polarized high frequency subarrays is an even number, the dual-polarized high frequency subarrays are symmetric about the axis of the multi-frequency array antenna, so that electrical characteristics of the dual-polarized high frequency subarrays can be relatively consistent.

Figure 6A:
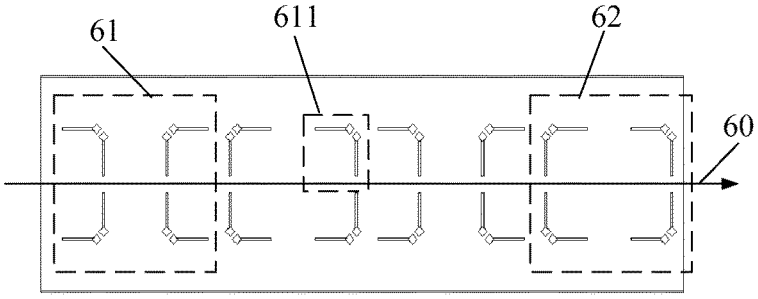
FIG. 6*a* is a schematic structural diagram of a dual-polarized low frequency subarray of another multi-frequency array antenna according to an embodiment of the present application.
Figure 6B:
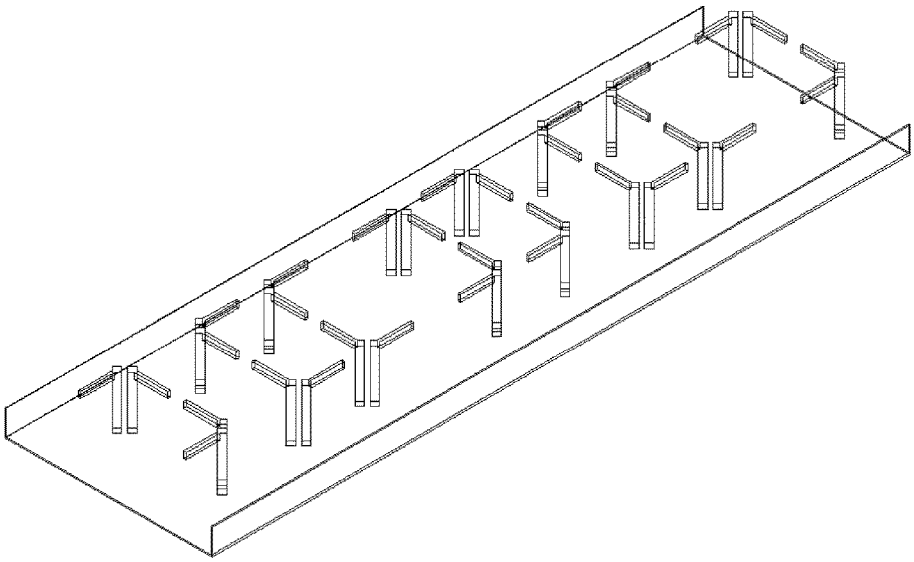
FIG. 6*b* is a three-dimensional schematic structural diagram of the dual-polarized low frequency subarray in the embodiment shown in FIG. 6*a;*
Figure 6C:
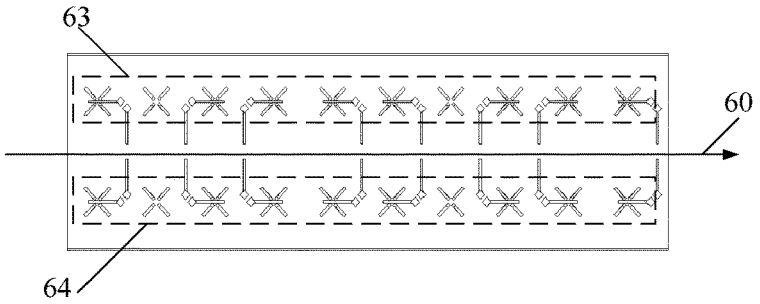
FIG. 6*c* to FIG. 6*e* are schematic structural diagrams of a multi-frequency array antenna that includes the dual-polarized low frequency subarray shown in FIG. 6*a;*

Refer to FIG. 6*a* to FIG. 6*c*, which are schematic structural diagrams of another multi-frequency array antenna according to an embodiment of the present application.

As shown in FIG. 6*a* and FIG. 6*b*, the multi-frequency array antenna also includes one dual-polarized low frequency subarray. The dual-polarized low frequency subarray includes two types of dual-polarized low frequency radiation unit pairs 61 and 62. The dual-polarized low frequency radiation unit pairs 61 and 62 are alternately arranged along an axis 60 of the multi-frequency array antenna. Each type of dual-polarized low frequency radiation unit pair includes four L-shaped low frequency radiation units 611. The four L-shaped low frequency radiation units of the dual-polarized low frequency radiation unit pair 61 form two C-shaped structures, where each C-shaped structure is formed by two L-shaped low frequency radiation units. The two C-shaped structures are arranged along the axis 60 of the multi-frequency array antenna, where openings of the two C-shaped structures face away from each other. The four L-shaped low frequency radiation units of the dual-polarized low frequency radiation unit pair 62 also form two C-shaped structures, where each C-shaped structure is formed by two L-shaped low frequency radiation units. The two C-shaped structures are arranged along the axis 60 of the multi-frequency array antenna, where openings of the two C-shaped structures face towards each other.

As shown in FIG. 6*c*, the multi-frequency array antenna includes two dual-polarized high frequency subarrays 63 and 64. The two dual-polarized high frequency subarrays 63 and 64 are symmetric about the axis 60 of the multi-frequency array antenna. Each dual-polarized high frequency subarray is formed by independent high frequency radiation units that are arranged along a direction of the axis 60 of the multi-frequency array antenna.

Figure 6D:
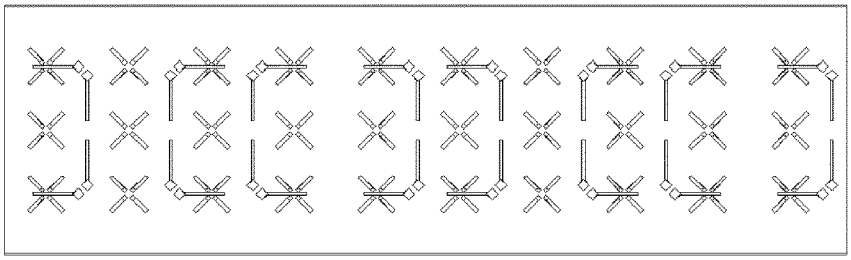
Figure 6E:
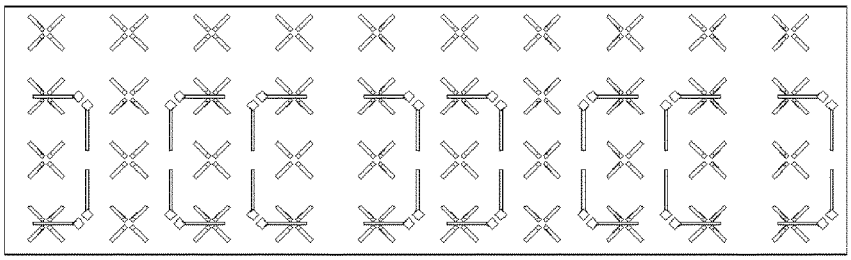

In another embodiment, the multi-frequency array antenna may include three or four dual-polarized high frequency subarrays. An arrangement manner of the dual-polarized high frequency subarrays may be shown in FIG. 6*d* or FIG. 6*e*. When a quantity of the dual-polarized high frequency subarrays is an even number, the dual-polarized high frequency subarrays are symmetric about the axis of the multi-frequency array antenna, so that electrical characteristics of the dual-polarized high frequency subarrays can be relatively consistent.

Figure 7A:
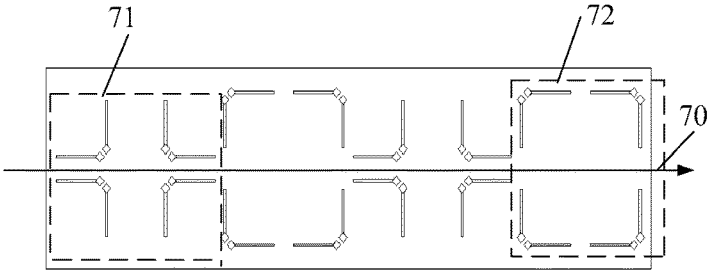
FIG. 7*a* is a schematic structural diagram of a dual-polarized low frequency subarray of another multi-frequency array antenna according to an embodiment of the present application.
Figure 7B:
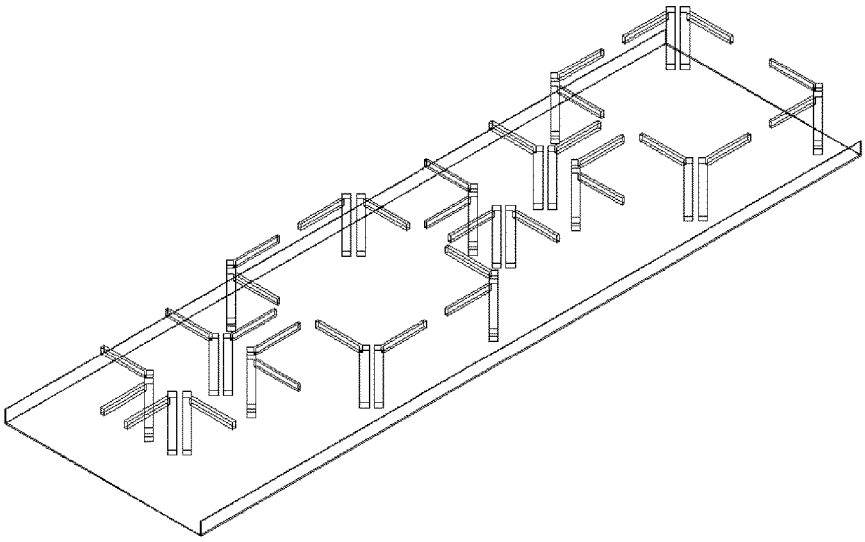
FIG. 7*b* is a three-dimensional schematic structural diagram of the dual-polarized low frequency subarray in the embodiment shown in FIG. 7*a;*
Figure 7C:
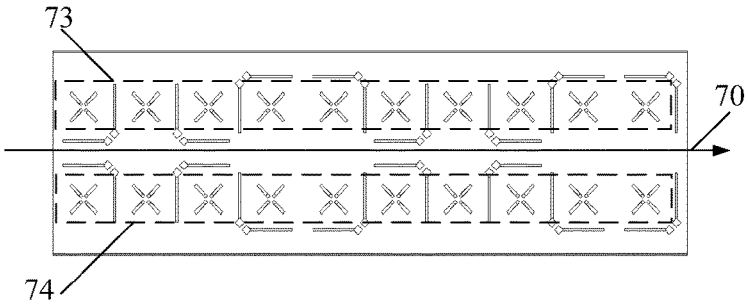
FIG. 7*c* to FIG. 7*e* are schematic structural diagrams of a multi-frequency array antenna that includes the dual-polarized low frequency subarray shown in FIG. 7*a;*

Refer to FIG. 7*a* to FIG. 7*c*, which are schematic structural diagrams of another multi-frequency array antenna according to an embodiment of the present application.

As shown in FIG. 7*a* and FIG. 7*b*, the multi-frequency array antenna also includes one dual-polarized low frequency subarray. The dual-polarized low frequency subarray includes two types of dual-polarized low frequency radiation unit pairs 71 and 72. The dual-polarized low frequency radiation unit pairs 71 and 72 are alternately arranged along an axis 70 of the multi-frequency array antenna. A difference between this dual-polarized low frequency subarray and the dual-polarized low frequency subarray shown in the foregoing FIG. 6*a* and FIG. 6*b* is that an arrangement manner of four L-shaped low frequency radiation units in the dual-polarized low frequency radiation unit pair 71 is different from an arrangement manner of the four L-shaped low frequency radiation units in the dual-polarized low frequency radiation unit pair 61. The four L-shaped low frequency radiation units in the dual-polarized low frequency radiation unit pair 61 form two C-shaped structures, where each C-shaped structure is formed by two L-shaped low frequency radiation units, and the two C-shaped structures are arranged along the axis 60 of the multi-frequency array antenna, where openings of the two C-shaped structures face away from each other. The four L-shaped low frequency radiation units in the dual-polarized low frequency radiation unit pair 71 are arranged to form a cross, where openings of L separately face towards four different directions. Arrangement manners of dual-polarized low frequency radiation units in the dual-polarized low frequency radiation unit pair 72 and the dual-polarized low frequency radiation unit pair 62 are the same.

As shown in FIG. 7*c*, the multi-frequency array antenna includes two dual-polarized high frequency subarrays 73 and 74. The two dual-polarized high frequency subarrays 73 and 74 are symmetric about an axis 70 of the multi-frequency array antenna. Each dual-polarized high frequency subarray is formed by independent high frequency radiation units that are arranged along a direction of the axis 70 of the multi-frequency array antenna.

Figure 7D:
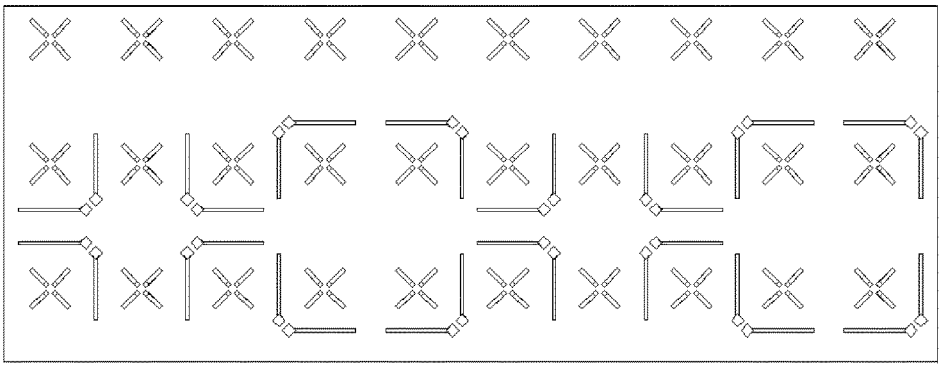
Figure 7E:
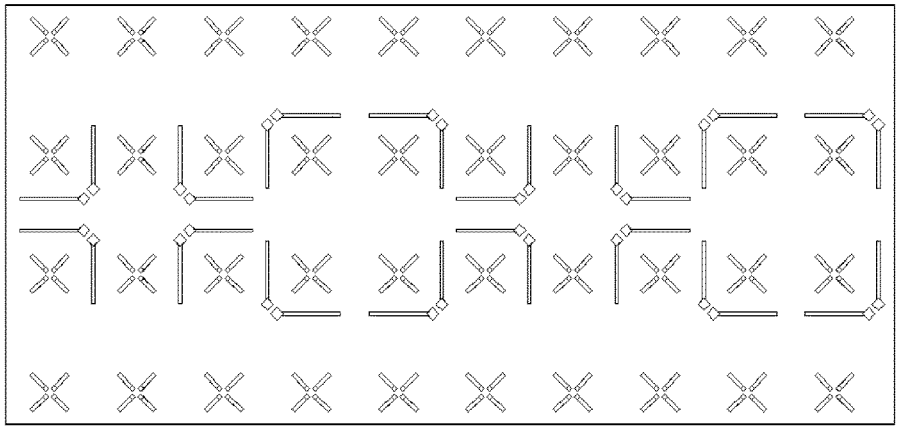

In another embodiment, the multi-frequency array antenna may include three or four dual-polarized high frequency subarrays. An arrangement manner of the dual-polarized high frequency subarrays may be shown in FIG. 7*d* or FIG. 7*e*. When a quantity of the dual-polarized high frequency subarrays is an even number, the dual-polarized high frequency subarrays are symmetric about the axis of the multi-frequency array antenna, so that electrical characteristics of the dual-polarized high frequency subarrays can be relatively consistent.

Figure 8A:
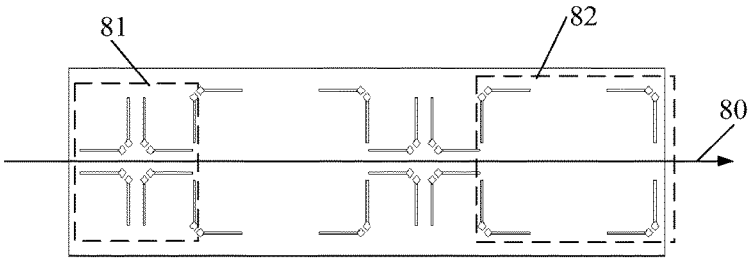
FIG. 8*a* is a schematic structural diagram of a dual-polarized low frequency subarray of another multi-frequency array antenna according to an embodiment of the present application.
Figure 8B:
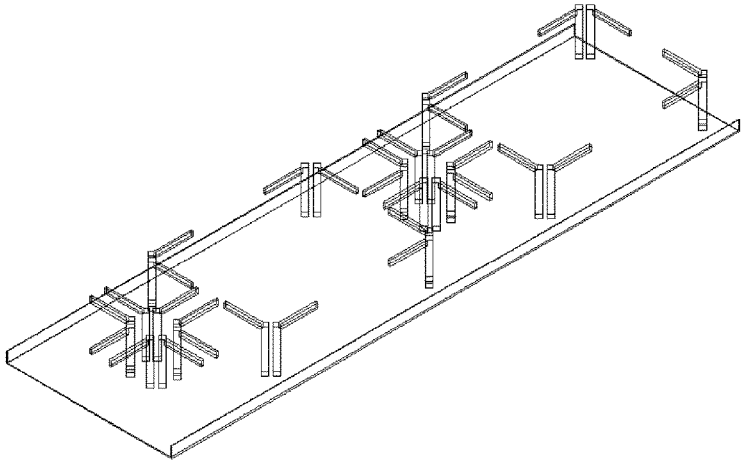
FIG. 8*b* is a three-dimensional schematic structural diagram of the dual-polarized low frequency subarray in the embodiment shown in FIG. 8*a;*
Figure 8C:
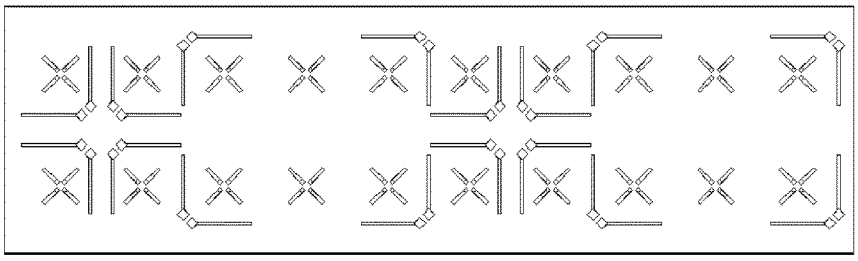
FIG. 8*c* to FIG. 8*e* are schematic structural diagrams of a multi-frequency array antenna that includes the dual-polarized low frequency subarray shown in FIG. 8*a;*
Figure 8D:
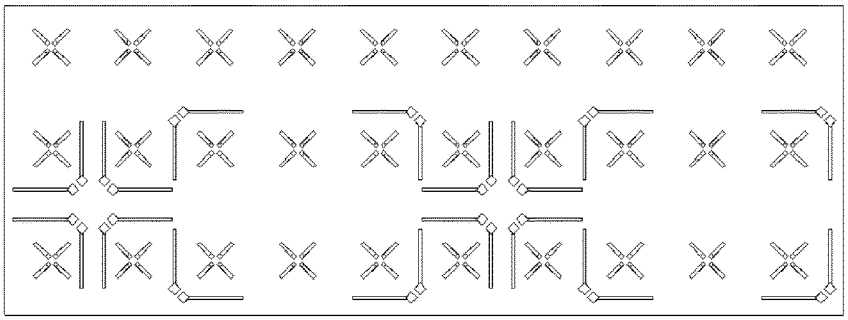
Figure 8E:
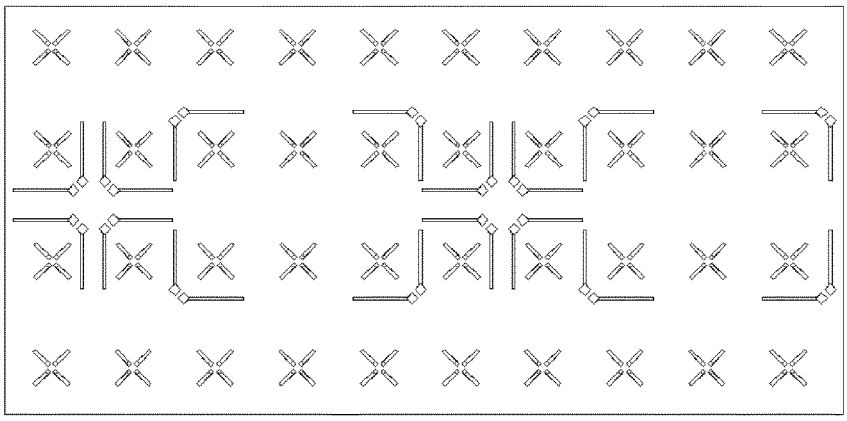

In another embodiment of the present application, as shown in FIG. 8*a* and FIG. 8*b*, the multi-frequency array antenna includes dual-polarized low frequency subarrays that are similar to those shown in FIG. 7*a* and FIG. 7*b*. Structures of dual-polarized low frequency radiation unit pairs 81 and 82 are similar to structures of the dual-polarized low frequency radiation unit pairs 71 and 72. The only difference is that a spacing, along a direction of an axis 80 of the multi-frequency array antenna, between low frequency radiation units in the dual-polarized low frequency radiation unit pair 81 is decreased, while a spacing, along the direction of the axis 80 of the multi-frequency array antenna, between low frequency radiation units in the dual-polarized low frequency radiation unit pair 82 is increased. As shown in FIG. 8*c*, FIG. 8*d*, and FIG. 8*e*, the multi-frequency array antenna may include two, three, or four dual-polarized high frequency subarrays. When a quantity of the dual-polarized high frequency subarrays is an even number, the dual-polarized high frequency subarrays are symmetric about the axis of the multi-frequency array antenna, so that electrical characteristics of the dual-polarized high frequency subarrays can be relatively consistent.

Figure 9A:
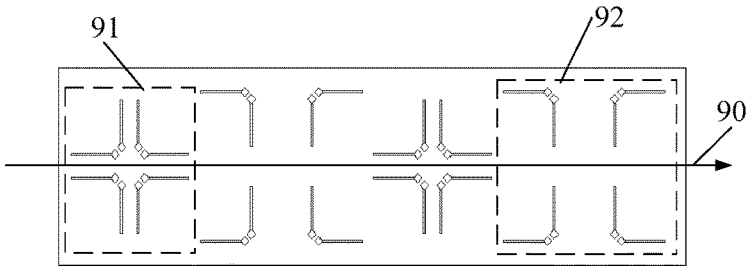
FIG. 9*a* is a schematic structural diagram of a dual-polarized low frequency subarray of another multi-frequency array antenna according to an embodiment of the present application.
Figure 9B:
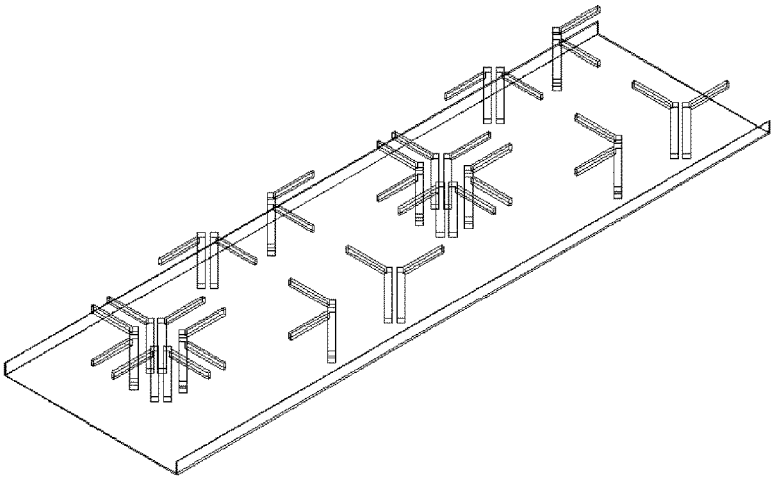
FIG. 9*b* is a three-dimensional schematic structural diagram of the dual-polarized low frequency subarray in the embodiment shown in FIG. 9*a;*
Figure 9C:
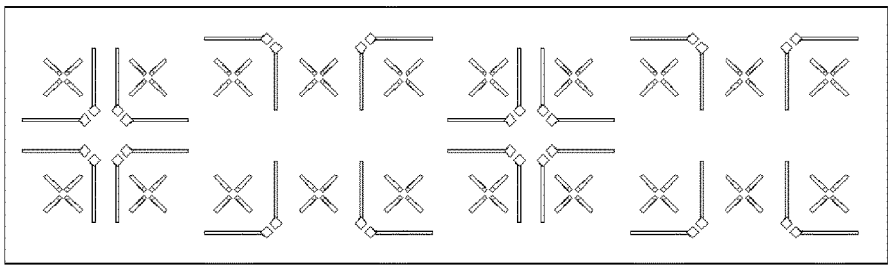
FIG. 9*c* to FIG. 9*e* are schematic structural diagrams of a multi-frequency array antenna that includes the dual-polarized low frequency subarray shown in FIG. 9*a;*
Figure 9D:
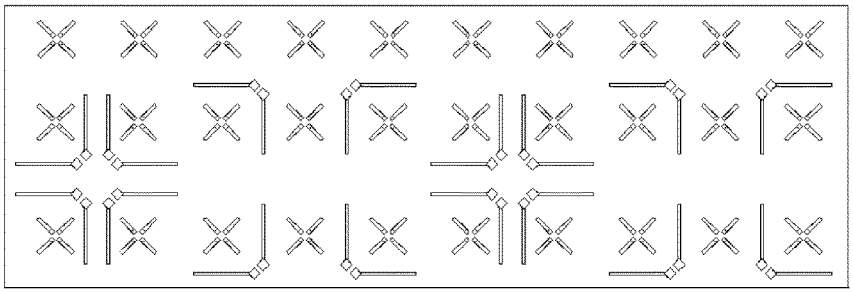
Figure 9E:
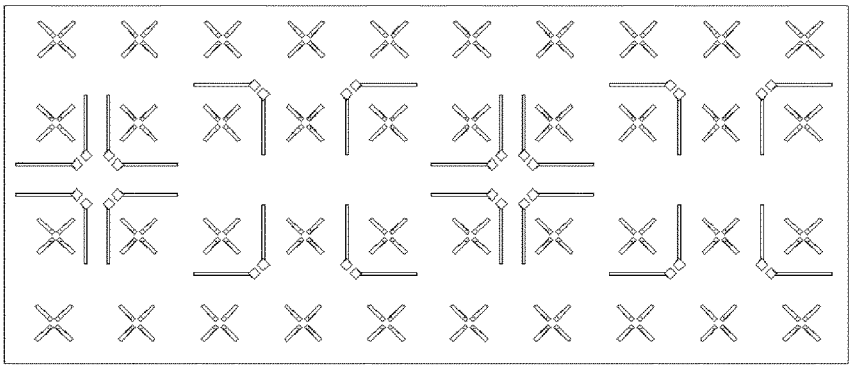

In another embodiment of the present application, as shown in FIG. 9*a* and FIG. 9*b*, the multi-frequency array antenna also includes one dual-polarized low frequency subarray. A dual-polarized low frequency radiation unit pair 91 is the same as the dual-polarized low frequency radiation unit pair 81. A dual-polarized low frequency radiation unit pair 92 is the same as the dual-polarized low frequency radiation unit pair 61. Two types of dual-polarized low frequency radiation unit pairs 91 and 92 are alternately arranged along an axis 90 of the multi-frequency array antenna. As shown in FIG. 9*c*, FIG. 9*d*, and FIG. 9*e*, the multi-frequency array antenna may include two, three, or four dual-polarized high frequency subarrays. When a quantity of the dual-polarized high frequency subarrays is an even number, the dual-polarized high frequency subarrays are symmetric about the axis of the multi-frequency array antenna, so that electrical characteristics of the dual-polarized high frequency subarrays can be relatively consistent.

Figure 10A:
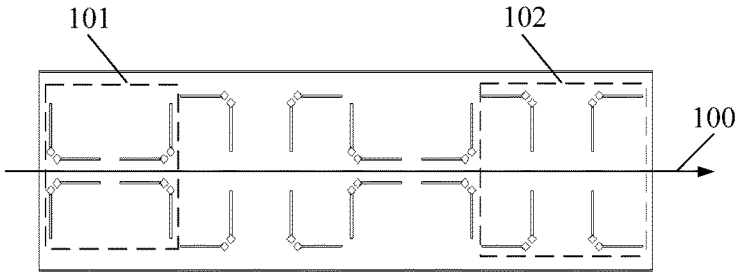
FIG. 10*a* is a schematic structural diagram of a dual-polarized low frequency subarray of another multi-frequency array antenna according to an embodiment of the present application.
Figure 10B:
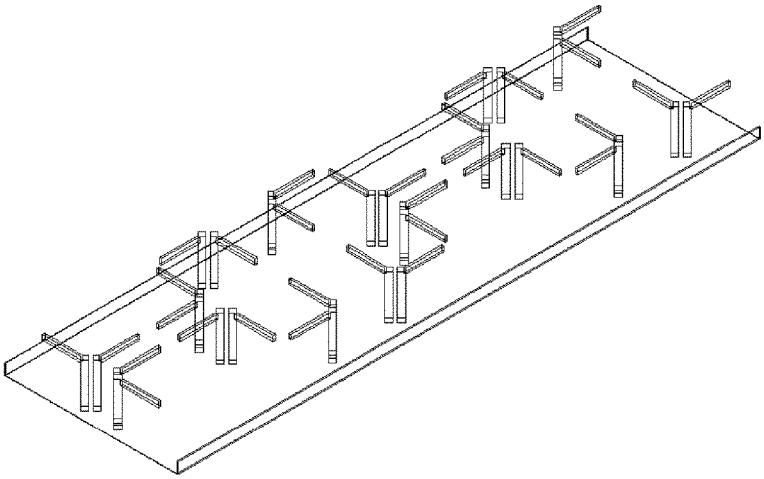
FIG. 10*b* is a three-dimensional schematic structural diagram of the dual-polarized low frequency subarray in the embodiment shown in FIG. 10*a*.
Figure 10C:
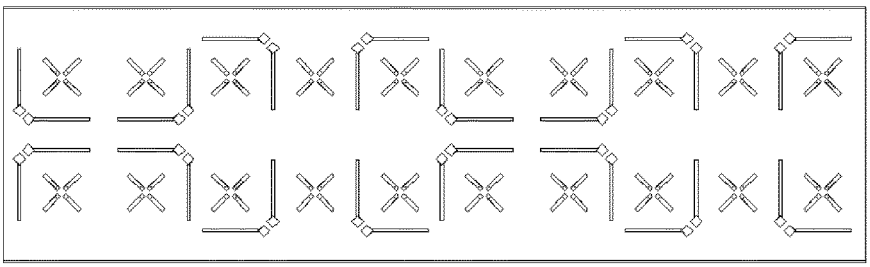
FIG. 10*c* to FIG. 10*e* are schematic structural diagrams of a multi-frequency array antenna that includes the dual-polarized low frequency subarray shown in FIG. 10*a.*

Refer to FIG. 10*a* to FIG. 10*c*, which are schematic structural diagrams of another multi-frequency array antenna according to an embodiment of the present application.

As shown in FIG. 10*a* and FIG. 10*b*, the multi-frequency array antenna includes one dual-polarized low frequency subarray. The dual-polarized low frequency subarray includes two types of dual-polarized low frequency radiation unit pairs 101 and 102. The dual-polarized low frequency radiation unit pairs 101 and 102 are alternately arranged along an axis 100 of the multi-frequency array antenna. Each type of dual-polarized low frequency radiation unit pair includes four L-shaped low frequency radiation units. An arrangement manner of four L-shaped low frequency radiation units in the dual-polarized low frequency radiation unit pair 102 is the same as that of the four L-shaped low frequency radiation units in the dual-polarized low frequency radiation unit pair 61. Four L-shaped low frequency radiation units in another type of dual-polarized low frequency radiation unit pair 101 form two C-shaped structures, where each C-shaped structure is formed by two L-shaped low frequency radiation units. The two C-shaped structures are symmetrically arranged along a direction that is perpendicular to the axis 60 of the multi-frequency array antenna, where openings of the two C-shaped structures face away from each other.

Figure 10D:
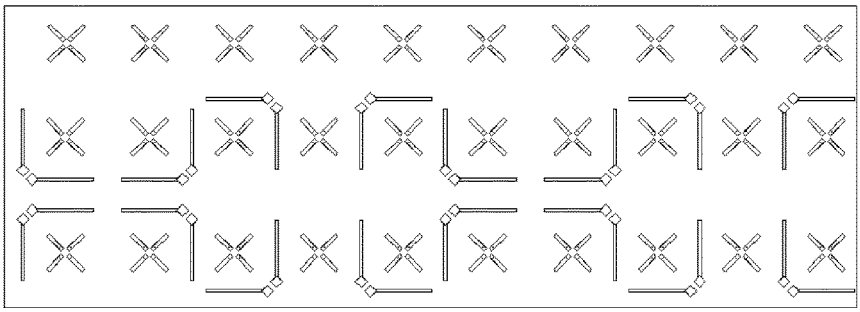
Figure 10E:
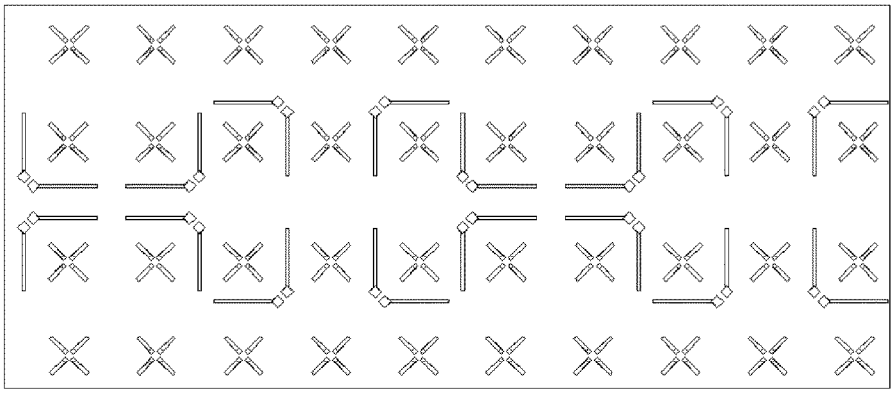

As shown in FIG. 10*c*, FIG. 10*d*, and FIG. 10*e*, the multi-frequency array antenna may include two, three, or four dual-polarized high frequency subarrays. When a quantity of the dual-polarized high frequency subarrays is an even number, the dual-polarized high frequency subarrays are symmetric about the axis of the multi-frequency array antenna, so that electrical characteristics of the dual-polarized high frequency subarrays can be relatively consistent.

Certainly, in other embodiments of the present application, the dual-polarized low frequency subarray may include other types of dual-polarized low frequency radiation unit pairs. The foregoing is merely examples.

In the embodiments of the present application, a dual-polarized low frequency subarray includes a dual-polarized low frequency radiation unit pair that includes multiple low frequency radiation units, which increases diameter utilization and improves a gain of the low frequency subarray. Moreover, arrays in the foregoing multi-frequency array antenna are designed to be more compact, and two or more types of low frequency radiation unit pairs are of different patterns and arranged flexibly; therefore, the radiation units are arranged to avoid each other according to structure forms of low frequency radiation units and high frequency radiation units, which increases a spacing between radiation units, and decreases mutual coupling between low frequency and high frequency. Further, dual-polarized high frequency subarrays are arranged to be symmetric about an axis of the multi-frequency array antenna, so that electrical performance indicators of the dual-polarized high frequency subarrays can be relatively consistent.

In the several embodiments provided in this application, it should be understood that the disclosed system and apparatus may be implemented in other manners. For example, the described apparatus embodiments are merely exemplary. In addition, the displayed or discussed mutual couplings or direct couplings or communication connections may be implemented through some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. Some or all of the units may be selected according to actual needs to achieve the objectives of the solutions of the embodiments.

In addition, functional units in the embodiments of the present application may be integrated into one processing unit, or each of the units may exist alone physically, or two or more units are integrated into one unit.

The foregoing descriptions are merely specific implementation manners of the present application, but are not intended to limit the protection scope of the present application. Any variation or replacement readily figured out by a person skilled in the art within the technical scope disclosed in the present application shall fall within the protection scope of the present application. Therefore, the protection scope of the present application shall be subject to the appended claims.

What is claimed is:

1. A multi-frequency array antenna, comprising:

a radome;

at least one dual-polarized high frequency subarray within the radome and arranged in parallel along an axial direction of the multi-frequency array antenna; and at least one dual-polarized low frequency subarray within the radome, arranged in parallel along the axial direction of the multi-frequency array antenna, and comprising at least two different types of dual-polarized low frequency radiation unit pairs;

wherein each of the dual-polarized low frequency radiation unit pairs comprises at least four low frequency radiation units, and the at least two different types of dual-polarized low frequency radiation unit pairs comprise:

(a) a first type, where a unit pair has two C-shaped structures facing away from each other; and (b) a second type, where a unit pair has two C-shaped structures facing towards each other.

2. The multi-frequency array antenna according to claim 1, wherein the low frequency radiation units in the at least two different types of dual-polarized low frequency radiation unit pairs are arranged in different alignments.

3. The multi-frequency array antenna according to claim 2, wherein the at least two different types of dual-polarized low frequency radiation unit pairs are alternately arranged along the axial direction of the multi-frequency array antenna.

4. The multi-frequency array antenna according to claim 1, wherein the dual-polarized low frequency radiation unit pair comprises four L-shaped low frequency radiation units.

5. The multi-frequency array antenna according to claim 1, wherein a quantity of the dual-polarized high frequency subarrays is two.

6. The multi-frequency array antenna according to claim 5, wherein the dual-polarized high frequency subarrays are symmetric about an axis of the multi-frequency array antenna.

7. The multi-frequency array antenna according to claim 1, wherein a quantity of the dual-polarized high frequency subarrays is three.

8. The multi-frequency array antenna according to claim 1, wherein a quantity of the dual-polarized high frequency subarrays is four.

9. The multi-frequency array antenna according to claim 8, wherein the dual-polarized high frequency subarrays are symmetric about an axis of the multi-frequency array antenna.

* * * * *